US006257246B1

(12) United States Patent
Kan

(10) Patent No.: US 6,257,246 B1
(45) Date of Patent: Jul. 10, 2001

(54) HAIR CARE DEVICE

(76) Inventor: Elvin Man Kit Kan, Flat A, 14/F, Block 5, Phoenix Court, 39 Kennedy Road, Wan Chai (HK)

( * ) Notice: Subject to any disclaimer, the term of this patent is extended or adjusted under 35 U.S.C. 154(b) by 0 days.

(21) Appl. No.: 09/583,562

(22) Filed: May 31, 2000

(51) Int. Cl.[7] ..... A45D 24/22
(52) U.S. Cl. ..... 132/112
(58) Field of Search ..... 132/112, 113, 132/114, 115, 116, 120, 121, 126, 129, 136, 141, 142, 147, 148, 313; 401/195, 126, 129, 124, 123, 270, 118, 137, 138, 268

(56) References Cited

U.S. PATENT DOCUMENTS 3,516,424 * 6/1970 Eagle ..... 132/313
3,565,541 * 2/1971 Vallis ..... 401/137
4,254,738 * 3/1981 Stanley ..... 132/112
4,934,855 * 6/1990 Recchelbacher ..... 132/148
5,213,430 * 5/1993 Pandola ..... 401/137
5,632,289 * 5/1997 Sharp ..... 132/147
5,725,130 * 3/1998 Kluge et al. ..... 132/112

* cited by examiner

*Primary Examiner*—John J. Wilson
*Assistant Examiner*—Edvanto C. Robert
(74) *Attorney, Agent, or Firm*—Rabin & Champagne, P.C.

(57) ABSTRACT

A hair device includes a comb supporting body and a hair grooming implement connected thereto. A dispenser is detachably mounted in a chamber defined by the back of the hair grooming implement and the comb supporting body. An opening is provided in the back of the hair grooming implement corresponding to the spray nozzle of the dispenser. The dispenser is propped against one end of the pressing member, the other end of the pressing member protrudes out from the comb supporting body. The hair care device has the feature of, while grooming or combing the hair, hair care liquid can be dispensed onto the hair at the same time, thus avoiding the inconvenience caused by the use of a separate hair grooming implement and a dispenser.

9 Claims, 3 Drawing Sheets

HAIR CARE DEVICE

BACKGROUND OF THE INVENTION

Usually hair grooming is carried out by using a brush or a comb along with the application of hair styling spirit or mousse to the hair by a dispenser to make the hair to fit perfectly. However, people have often had inconvenience that a comb or brush and a dispenser must be alternately used. Moreover, when going out they must carry a comb along with a dispenser for dispensing hair care liquid, thereby the luggage burden is increased.

The object of the present invention is to provide a hair care device by which, while the hair is groomed, a hair care liquid such as styling spirit, mousse, dyeing liquid or perfume can be dispensed at the same time, thereby the inconvenience of alternately using a comb and a dispenser and the added luggage burden can be avoided.

SUMMARY OF THE INVENTION

In order to achieve the above-mentioned object, the present invention provides a hair care device comprising a comb supporting body, and a hair grooming implement connected to the comb supporting body in which there is formed a chamber between the back of the hair grooming implement and the comb supporting body, and a dispenser is detachably mounted in the chamber, the spray nozzle of the dispenser is aligned with an opening in the back of the hair grooming implement, the pressing member of the dispenser partially protrudes from the said chamber.

Wherein the hair grooming implement is detachably connected to the comb supporting body.

Wherein the comb supporting body comprises a detachable upper cover and a front guard cover, and in the front guard cover is provided a hole through which the pressing member of the dispenser can protrude out.

Wherein, the spray pump of the dispenser is transparent, in the upper cover of the comb supporting body is provided an observation hole the position of which corresponds to the position of the spray pump.

Wherein, a groove is formed in the back surface of the hair grooming implement, the shape of the groove corresponds to the shape of the spray pump.

Wherein the said hair grooming implement is a hair comb.

The hair care device according to the present invention comprises a comb supporting body and a hair grooming implement, particularly, in the chamber formed by the hair grooming implement and the comb supporting body is mounted a dispenser, by pressing the pressing member protruding out from the chamber, it is possible that while grooming or combing the hair, the hair care liquid within the dispenser can be dispensed out onto the hair through the opening in the hair grooming implement, thereby avoiding the inconvenience of the swapping between the comb and the dispenser as with the prior art, and avoiding the added luggage burden caused by carrying separate comb and dispenser.

BRIEF DESCRIPTION OF DRAWINGS

In the following, the object, features and effects will be further described through an embodiment with reference to the accompanying drawings, in which.

DETAILED DESCRIPTION OF PREFERRED EMBODIMENT

Figure 1:
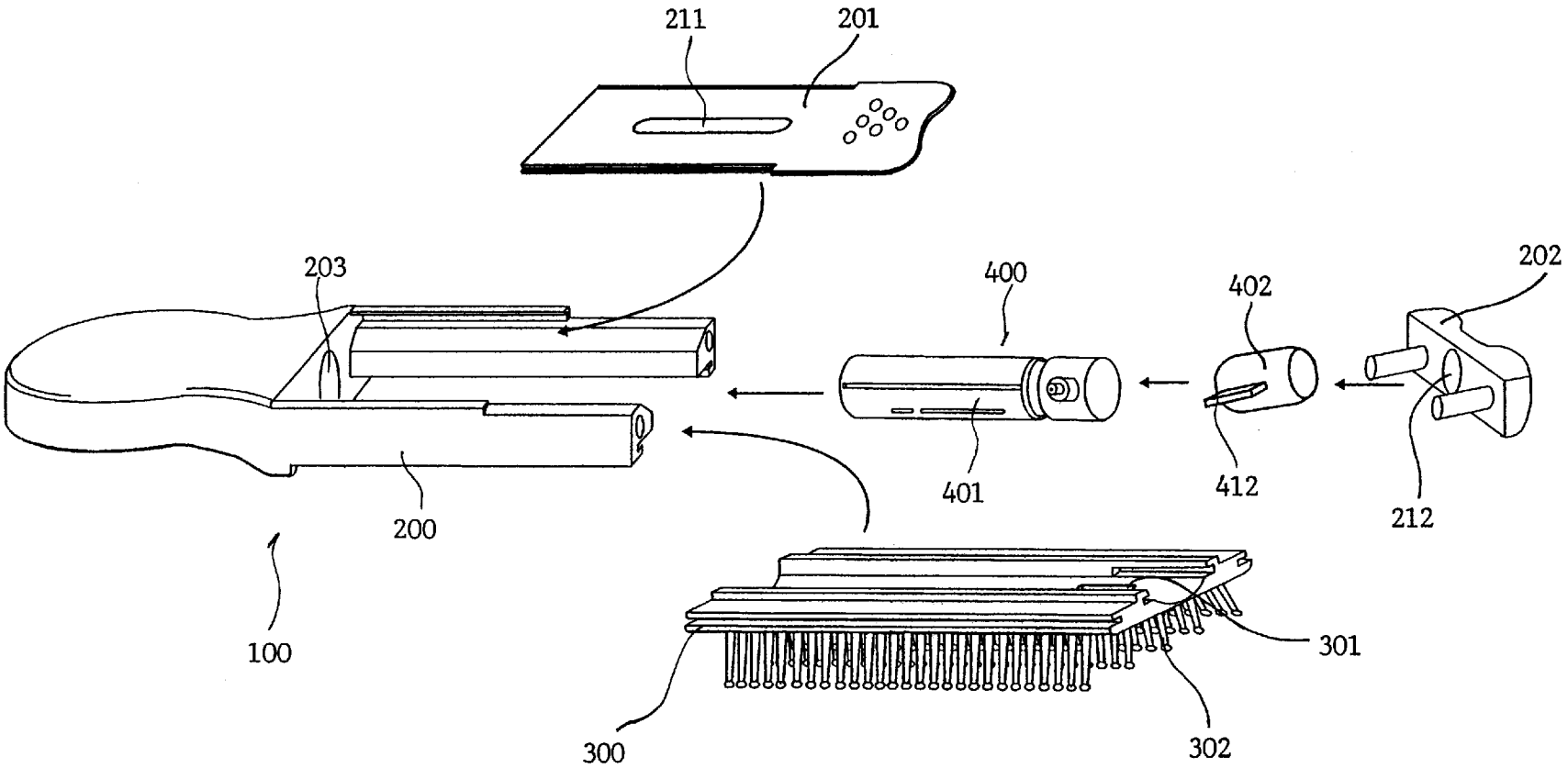
FIG. 1 is a perspective exploded schematic view of an embodiment of a hair care device according to the present invention.

Referring to the accompanying drawings, the hair care device 100 of the embodiment according to the present invention is of a hair comb like shape. It comprises a comb supporting body 200 and a hair grooming implement 300, as shown in FIG. 1. There are inlaying grooves, in the comb supporting body 200. The hair grooming implement 300 has teeth for brushing or combing hair on a front surface, and has inlaying slips or strips that can be inserted into the comb supporting body 200 and that can be detached when required. Of course, the comb supporting body 200 and the hair grooming implement 300 can be made into an integral whole (not shown).

Figure 2:
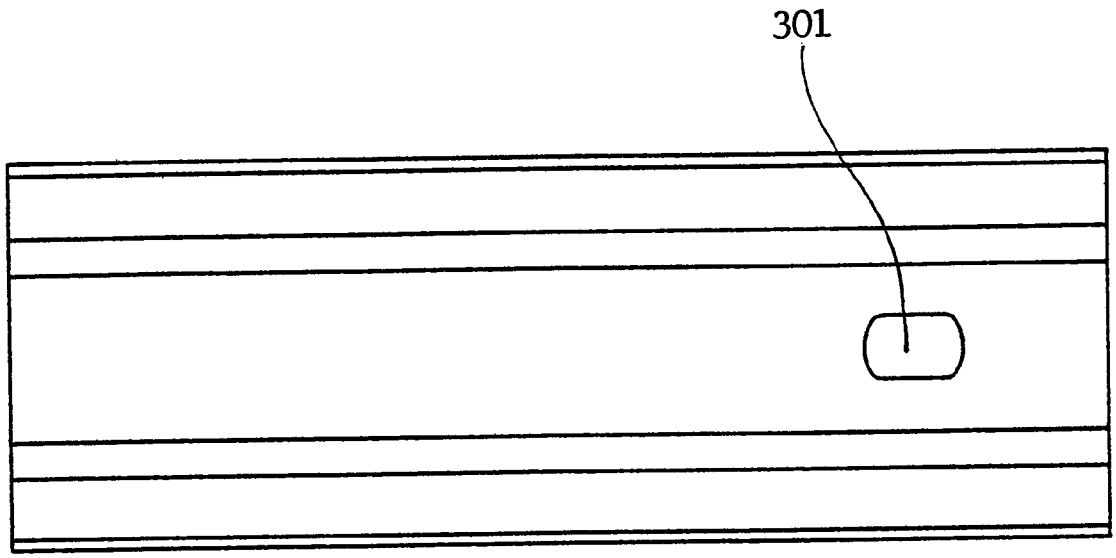
FIG. 2 is a top view of the hair grooming implement used in FIG. 1.

The comb supporting body 200 comprises a detachable upper cover 201 and a detachable front guard cover 202. When the hair grooming implement 300 is inserted into the comb supporting body 200, a chamber is formed by the back thereof, the upper cover 201 and the front guard cover 202. A dispenser 400 can be placed in the chamber. A hole 203 is defined in the comb supporting body 200, in which the end of the pump of the dispenser 400 can be fixed. At the same time, the pressing member 402 of the dispenser 400 partially protrudes out from the hole 212 defined in the front guard 202. The stop block 412 on the pressing member 402 can prevent the pressing member from sliding out from the hole 212. Furthermore, as shown in FIG. 2, there is an opening 301 in the back of the hair grooming implement 300. The spray nozzle of the dispenser 400 corresponds to this opening 301 in the assembled state, so that the hair care liquid can be dispensed onto the hair.

In addition, there is a groove 302 in the back of the hair grooming implement 300. The shape of the groove 302 is complementary with respect to the shape of the pump 401 of the dispenser 400. In this way, the dispenser 400 is placed in a stable state in the chamber.

In order that the operation is more convenient, the reservoir 401 of the dispenser 400 can be made of transparent material, and a rectangular observation hole 211 corresponding to the position of the pump when assembled can be defined in the upper cover 201 of the comb supporting body to observe the amount of the hair care liquid present in the pump.

Figure 3:
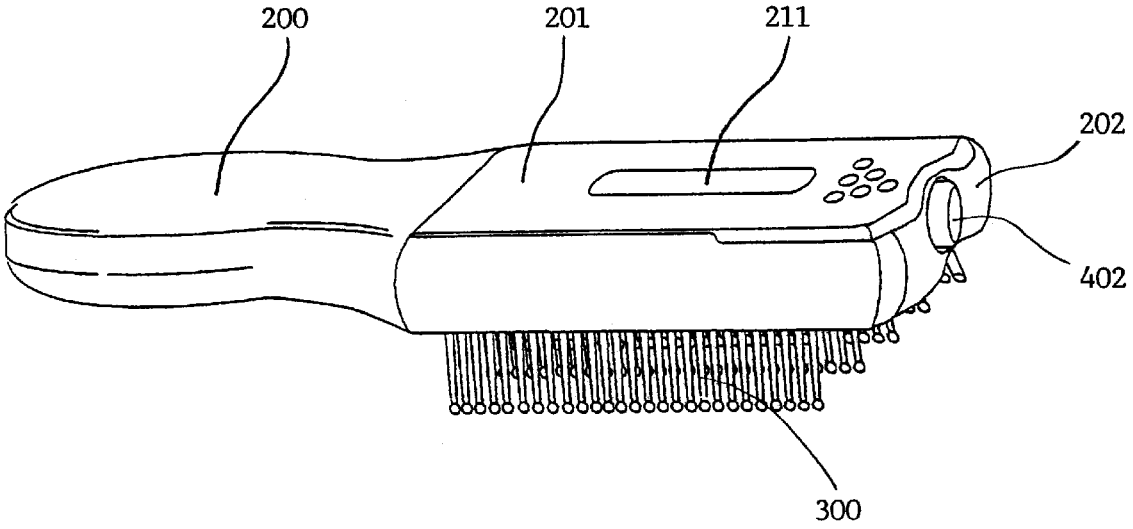
FIG. 3 is a perspective view of the assembled hair care device shown in FIG. 1.

FIG. 3 shows an assembled hair care device according to the present invention. The hair care device combines a hair grooming comb with the hair care liquid dispenser, therefore it is convenient to carry it. In addition, in use, it is only necessary to press the pressing member 402 for the hair care liquid to be dispensed on the hair through the opening 301 of the hair grooming implement 300. In this way, when the hair is groomed, the hair care liquid can be dispensed onto the hair at the same time, thereby avoiding the inconvenience of swapping of the comb and the dispenser. Furthermore, the amount of hair care liquid present in the dispenser can be observed through the observation hole 211 defined in the upper cover 201 of the comb supporting body to timely replace the exhausted dispenser. For the replacement of the dispenser, it is only necessary to dismount one of the upper cover 201, the hair grooming implement 300 (if integrated with the comb supporting body, it can not be detached) and the front guard cover 202 to detach the exhausted dispenser placed in the chamber for it to be replaced, or the dispenser may be refilled with hair care liquid.

In addition, the hair grooming implement 300 can be replaced by a comb (having a single row of prongs) or any other hair grooming implement.

The above described embodiment is only one example of the present invention, it should be noted that various modifications and/or alterations to the described embodiment may be made by persons skilled in the art without departing from the scope of the present invention, all these modifications and/or alterations should fall within the protection scope of the present invention.

What is claimed is:

1. A hair care device, comprising:

a comb supporting body;

a hair grooming implement connected to said comb supporting body, said comb supporting body and a back of said hair grooming implement defining a chamber, said hair grooming implement having a plurality of teeth on a front surface thereof, said hair grooming implement further having an opening extending from the front surface to the back surface and being disposed between respective ones of the teeth, the opening communicating the chamber with a region between respective ones of the teeth;

a dispenser detachably mounted in the chamber and having a reservoir completely disposed within the chamber, said dispenser having a spray nozzle positioned to correspond to the opening in said hair grooming implement; and a pressing member having one end protruding out from said comb supporting body, and having another end positioned against said dispenser.

2. The hair care device according to claim 1, wherein a curved groove is provided in the back of the hair grooming implement, the groove having a shape matched with a shape of said dispenser.

3. The hair care device according to claim 1, wherein the spray nozzle of said dispenser protrudes out of the opening.

4. The hair care device according to claim 3, wherein said hair grooming implement is a comb.

5. The hair care device according to claim 3, wherein said hair grooming implement is a brush.

6. A hair care device, comprising:

a comb supporting body;

a hair grooming implement connected to said comb supporting body, said comb supporting body and a back of said hair grooming implement defining a chamber, said hair grooming implement having an opening;

a dispenser detachably mounted in the chamber, said dispenser having a spray nozzle positioned to correspond to the opening in said hair grooming implement;

a pressing member having one end positioned against said dispenser;

an upper cover detachably connected to said comb supporting body, said upper cover defining an upper side of the chamber; and a front guard cover detachably connected to said comb supporting body, said front guard cover defining a side edge of the chamber, said pressing member having another end protruding out from said front guard cover.

7. The hair care device according to claim 6, wherein said front guard cover is provided with a hole through which the another end of said pressing member protrudes.

8. The hair care device according to claim 6, wherein said upper cover is provided with an observation hole for observing a liquid level inside said dispenser.

9. A hair care device, comprising:

a comb supporting body;

a hair grooming implement connected to said comb supporting body, said comb supporting body and a back of said hair grooming implement defining a chamber, said hair grooming implement having an opening;

a dispenser detachably mounted in the chamber, said dispenser having a spray nozzle positioned to correspond to the opening in said hair grooming implement; and a pressing member having one end protruding out from said comb supporting body, said dispenser being positioned against another end of said pressing member, said pressing member being provided with a stop block slidably disposed in a groove formed in said hair grooming implement.

* * * * *